US010803695B2

(12) United States Patent
Larsen et al.

(10) Patent No.: US 10,803,695 B2
(45) Date of Patent: Oct. 13, 2020

(54) GAMING SYSTEM AND METHOD FOR COLLECTING, COMMUNICATING AND TRACKING EYE GAZE DATA

(71) Applicant: IGT, Las Vegas, NV (US)

(72) Inventors: Kurt Larsen, Las Vegas, NV (US); Marcus Schwendener, Reno, NV (US)

(73) Assignee: IGT, Las Vegas, NV (US)

( * ) Notice: Subject to any disclaimer, the term of this patent is extended or adjusted under 35 U.S.C. 154(b) by 86 days.

(21) Appl. No.: 16/058,313

(22) Filed: Aug. 8, 2018

(65) Prior Publication Data

US 2020/0051367 A1 Feb. 13, 2020

(51) Int. Cl.
*G07F 17/32* (2006.01)

(52) U.S. Cl.
CPC ..... *G07F 17/3206* (2013.01); *G07F 17/323* (2013.01); *G07F 17/326* (2013.01); *G07F 17/3209* (2013.01); *G07F 17/3239* (2013.01); *G07F 17/3258* (2013.01); *G07F 17/3262* (2013.01)

(58) Field of Classification Search
None
See application file for complete search history.

(56) References Cited

U.S. PATENT DOCUMENTS 7,617,151 B2 11/2009 Rowe
7,815,507 B2 10/2010 Parrott et al.
8,955,974 B2 2/2015 Gross et al.
8,979,640 B2 3/2015 Stewart
9,104,467 B2 8/2015 Frank et al.
9,202,334 B2 12/2015 Adiraju et al.
9,997,009 B2 6/2018 Froy et al.
9,999,805 B2 6/2018 Ahuja et al.
1,007,423 A1 9/2018 Froy et al.
1,008,982 A1 10/2018 Froy et al.
2004/0166931 A1 8/2004 Criss-Puszkiewicz et al.
2005/0282603 A1* 12/2005 Parrott ..... G06F 3/013 463/1
2012/0295708 A1 11/2012 Hernandez-Abrego et al.
2013/0137516 A1 5/2013 Griswold et al.
2013/0267317 A1* 10/2013 Aoki ..... G07F 17/3206 463/32
2014/0168056 A1 6/2014 Swaminathan et al.
2014/0184550 A1 7/2014 Hennessey et al.
2014/0274388 A1* 9/2014 Nguyen ..... G07F 17/3206 463/31
2014/0323194 A1 10/2014 Keilwert
2016/0093136 A1* 3/2016 Lyons ..... G07F 17/3206 463/21
2017/0169649 A1* 6/2017 Froy ..... G07F 17/3223
2017/0329015 A1* 11/2017 Clare ..... G01S 19/19
2017/0361157 A1 12/2017 Ahuja et al.

* cited by examiner

*Primary Examiner* — Jason T Yen
(74) *Attorney, Agent, or Firm* — Neal, Gerber & Eisenberg LLP

(57) ABSTRACT

In various embodiments, the present disclosure relates generally to gaming systems and methods for collecting eye gaze data associated with a player's experience at an electronic gaming machine and utilizing one or more electronic gaming machine communication links to transmit the collected eye gaze data to one or more entities for further analysis.

18 Claims, 6 Drawing Sheets

1000

GAMING SYSTEM AND METHOD FOR COLLECTING, COMMUNICATING AND TRACKING EYE GAZE DATA

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager. Generally, symbols or symbol combinations which are less likely to occur provide higher awards. Secondary or bonus games are also known in gaming machines. The secondary or bonus games usually provide an additional award to the player.

SUMMARY

In certain embodiments, the present disclosure relates to an electronic gaming machine including a display device, an eye gaze data capture device, a communication interface, an input device, a processor, and a memory device which stores a plurality of instructions. When executed by the processor, the instructions cause the processor to cause the display device to display content, and upon an occurrence of an eye gaze data tracking initiation event, cause the eye gaze data capture device to collect player eye gaze data relative to the displayed content. When executed by the processor upon an occurrence of a collected data upload event, the instructions cause the processor to communicate, via the communication interface, the collected player eye gaze data to a first server configured to analyze the collected player eye gaze data.

In certain embodiments, the present disclosure relates to a gaming establishment component including a communication interface configured to communicate with an electronic gaming machine which, upon an occurrence of an eye gaze data tracking initiation event, causes an eye gaze data capture device to collect player eye gaze data relative to content displayed by an electronic gaming machine display device. The gaming establishment component of these embodiments also includes a processor, and a memory device which stores a plurality of instructions. When executed by the processor, upon an occurrence of a collected data upload event, the instructions cause the processor to receive, via the communication interface and from the electronic gaming machine, the collected player eye gaze data. When executed by the processor, the instructions also cause the processor to analyze the collected player eye gaze data, and communicate, via the communication interface and to the electronic gaming machine, at least one modification of the electronic gaming machine, the modification being based on the analyzed player eye gaze data.

In certain embodiments, the present disclosure relates to a method of operating an electronic gaming machine including displaying, by a display device, content, and upon an occurrence of an eye gaze data tracking initiation event, causing an eye gaze data capture device to collect player eye gaze data relative to the displayed content. Upon an occurrence of a collected data upload event, the method also includes communicating, via a communication interface, the collected player eye gaze data to a first server configured to analyze the collected player eye gaze data.

Additional features and advantages are described in, and will be apparent from, the following Detailed Description and the figures.

DETAILED DESCRIPTION

Gaze Data Collection and Analysis

Figure 1:
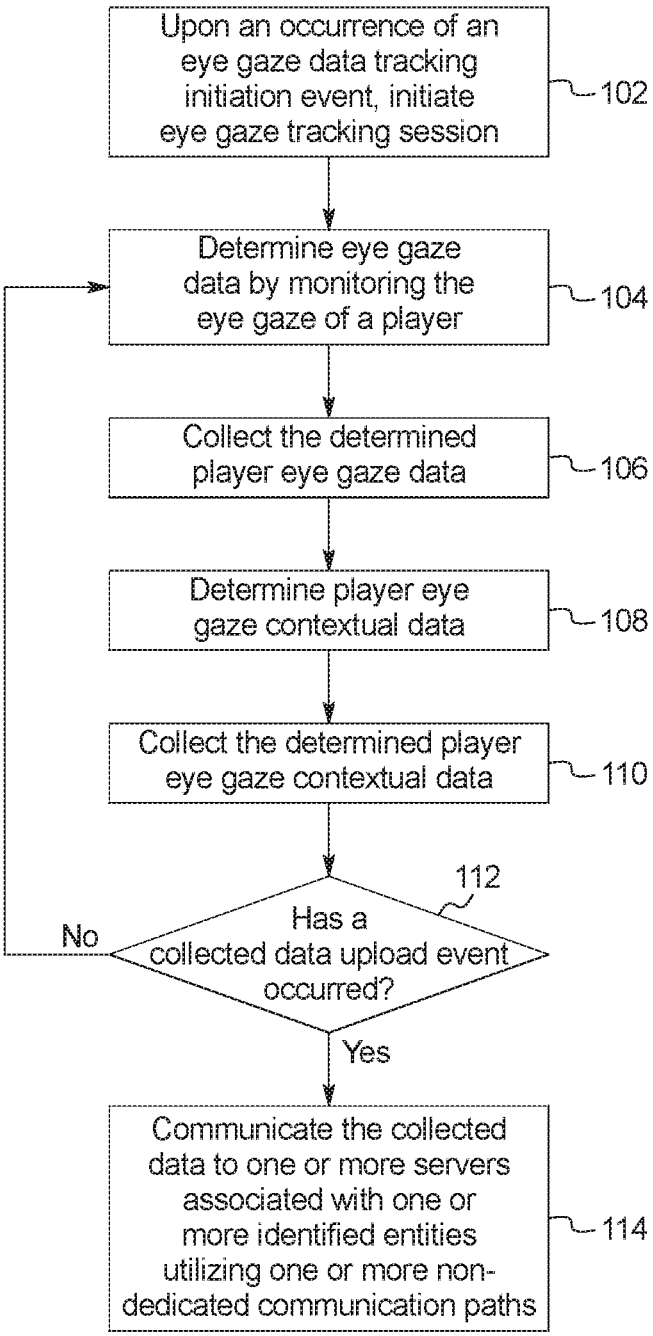
FIG. 1 is a flow chart an example process for operating a gaming system which tracks player eye gaze data and communicates such data to one or more servers for analysis.

In various embodiments, the present disclosure generally relates to gaming systems and methods for collecting eye gaze data associated with a player's experience at an electronic gaming machine ("EGM") and utilizing one or more EGM communication links to transmit the collected eye gaze data to one or more entities for further analysis. In these embodiments, the EGM employs one or more eye gaze capture devices, such as eye gaze data capture cameras, to monitor a player's eye gaze which the EGM collects as player eye gaze data. The player eye gaze data of these embodiments includes where an eye gaze of a player is focusing on a display device of the EGM, when the eye gaze occurred, and a duration of the eye gaze. The player eye gaze data further includes or is otherwise associated with player eye gaze contextual data such as game based display data (i.e., content displayed in association with one or more plays of one or more games of the EGM and the timing such content was displayed during a player's gaming session at the EGM) and/or non-game based display data (e.g., content displayed independent of any plays of any games of the EGM and the timing such content was displaying in association with the player's gaming session at the EGM) associated with the player's gaming experience at a gaming establishment. Such monitoring of the player's eye gaze data, when coupled with the collected player eye gaze contextual data provides that what displayed content the player looked at (or conversely what displayed content the player ignored) and how long the player looked at different displayed content can be collected to provide a more complete picture of how the player interacted with the EGM during a gaming session.

In various embodiments, in addition to collecting player eye gaze data and player eye gaze contextual data associated with such player eye gaze data, following a collected data upload event, such as an eye gaze data request event associated with an identified entity, the EGM utilizes a communication interface associated with the identified entity to communicate some or all of the collected data to one or more servers associated with the identified entity. That is, in certain embodiments, rather than utilizing a dedicated communication interface to communicate the collected eye gaze data to one or more servers, the EGM utilizes one or more legacy communication interfaces to communicate such collected eye gaze data. For example, at periodic intervals, the EGM utilizes an existing wide area progressive award communication link (which a gaming establishment utilizes to communicate game play data to a third party, such as an EGM manufacturer, maintaining a wide area progressive award) to communicate the collected data to one or more servers of the operator of the wide area progressive award. In another example, upon receiving a data request from a gaming establishment's installed player tracking system, the EGM utilizes an existing player tracking system communication link to communicate the collected data to one or more servers of an operator of an installed player tracking system. It should be appreciated that utilizing one or more legacy communication interfaces of an EGM enables the EGM to piggyback on existing communication infrastructures to enable legacy servers access to the collected data without having to install new communication lines to report the relatively vast amount of collected data.

In various embodiments, after receiving the collected data from one or more EGMs over one or more of the EGMs existing communication interfaces, the identified entity compiles the data from the various reporting EGMs. Following such a compilation of the collected data, the identified entity mines, analyses and/or shares the data to determine how players react to different displayed events (i.e., where did the player look responsive to different displayed events and how long did the player hold that gaze) to gauge how effective the different displayed events are and whether the content of the displayed event, the timing of the displayed event and/or any other characteristic of the displayed event should be modified. For example, an EGM manufacturer can analyze the received data pertaining to what players looked at during one or more games played to determine how players reacted to different displayed game events (in terms of what the player looked at prior to, during and after the game event) to alter the operation of future EGMs to account for player's behaviors. In this example, by understanding how effective different game features displayed by the EGM are (in terms of how long players looked at such game features), EGM manufacturers can design EGMs which emphasize certain game features over other game features. In another example, a gaming establishment operator can analyze the received data pertaining to what players looked at while one or more advertisements were displayed to determine how effective different advertisements displayed by the EGM (in terms of what the player looked at prior to, during and after the displayed advertisement) are compared to other stimuli. In this example, by understanding how effective different advertisements displayed by the EGM are, the gaming establishment operator can better focus their marketing campaign.

FIG. 1 is a flowchart of an example process or method of operating the gaming system of the present disclosure. In various embodiments, the process is represented by a set of instructions stored in one or more memories and executed by one or more processors. Although the process is described with reference to the flowchart shown in FIG. 1, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed.

In various embodiments, upon an occurrence of an eye gaze data tracking initiation event, the EGM initiates an eye gaze tracking session as indicated in block 102 of FIG. 1.

In certain embodiments, an eye gaze data tracking initiation event occurs when the EGM detects, such as using one or more cameras and/or weight sensors, the presence of a player at the EGM or movement proximate to the EGM. In certain embodiments, an eye gaze data tracking initiation event occurs when a player logs in to a player tracking account at the EGM. In certain embodiments, an eye gaze data tracking initiation event occurs when the player deposits an amount of funds on a credit balance to fund a gaming session. In certain embodiments, the eye gaze data tracking initiation event occurs when a pairing or linkage occurs between a mobile device and the EGM (or a component of a gaming establishment management system, such as a slot machine interface board ("SMIB"), located inside the EGM).

As indicated in blocks 104 and 106 of FIG. 1, for the initiated eye gaze tracking session, the EGM determines and collects player eye gaze data by monitoring the eye gaze of the player.

In certain embodiments, following the occurrence of the eye gaze data tracking initiation event, the EGM continuously monitors the eye gaze of the player to generate a continuous stream of eye gaze data. In certain embodiments, following the occurrence of the eye gaze data tracking initiation event, the EGM sporadically or regularly monitors the eye gaze of the player to generate packets of eye gaze data. In these embodiments, at designated intervals, such as based on time or changes to the displayed content of the EGM, the EGM monitors the eye gaze of the player.

In various embodiments, to monitor the eye gaze of the player to determine player eye gaze data, the EGM utilizes one or more gaze capture devices, such as one or more data capture camera devices, that detect one or more spectra of light, and/or one or more sensors (e.g., optical sensors) to detect eye movements, eye gestures, player positions and movements. In certain embodiments, the one data capture camera device is used to implement tracking recognition techniques to collect player eye gaze data, player eye gesture data, and player movement data. In such embodiments, the data capture camera device detects, in real-time, the position of the player's eyes (i.e., the physical location of the player's eyes) in three-dimensional space and the focus of the player's gaze (i.e., the focus of the gaze on a display device of the EGM) in two dimensional-space and/or three-dimensional space. The EGM then utilizes the detected eye movements, eye gestures, player positions and movements to determine the location of the eye gaze of the player relative to a displayed viewing area of a display device (i.e., the determined player eye gaze data) by mapping the determined location of the player eye gaze on the display device to the viewing area.

In various embodiments, as part of (or alternatively in association with) the determined and collected eye gaze data, for the initiated eye gaze tracking session, the EGM additionally determines and collects various player eye gaze contextual data as indicated in blocks 108 and 110. Such data provides context regarding the determined eye gaze data by correlating what displayed content the player was looking at on the viewing area of the display device of the EGM, when the player was looking at such displayed content and what events occurred before and/or after the player looked at such displayed content. More specifically, the EGM utilizes the mapped location of the player eye gaze on the display device to the viewing area in conjunction with the player eye gaze contextual data (i.e., what content is displayed by the display device on the viewing area) to determine what displayed content the player was looking at at different points in time.

In certain embodiments, the collected player eye gaze contextual data is based on one or more tracked gaming events which are displayed during or otherwise occur in association with one or more plays of one or more games at the EGM. In different embodiments, the tracked gaming events which the EGM collects data regarding what was displayed prior to, during and/or after such events include, but are not limited to: a deposit of an amount of funds at the EGM; an identification of a player at the EGM; a placement of a wager (regardless of the wager amount); a placement of a side-wager (regardless of the side-wager amount); a wager on a number of paylines; a wager on a designated payline; a wager on a number of ways to win; a speed of play by a player; a change in a speed of play by a player; a betting pattern by a player; a change in betting pattern by a player; a change in a type of game played; an activation of a reel; a stopping of a reel, an activation of a plurality of reels; a stopping of a plurality of reels, a generation of any outcome (or a designated outcome); a generation of any outcome (or a designated outcome) associated with an award; a generation of any outcome (or a designated outcome) associated with an award over a designated value; a generation of an outcome on a designated payline; a generation of an outcome in a scatter configuration; a generation of a winning way to win; a generation of a designated symbol or symbol combination; a generation of a designated symbol or symbol combination on a designated payline; a generation of a designated symbol or symbol combination in a scatter configuration; a payment of an award amount; a triggering of a play of a secondary game; an activation of a secondary display; an activation of a community award generator; and/or a generation of any outcome (or a designated outcome) in a secondary game.

In certain embodiments, the collected player eye gaze contextual data is additionally or alternatively based on zero, one or more actions taken, such as via zero, one or more inputs, which occur after one or more events which are displayed during or otherwise occur in association with one or more plays of one or more games at the EGM. For example, the collected data includes which inputs are made by a player responsive to which images are displayed to the player as well as the timing of such inputs.

In certain embodiments, the collected player eye gaze contextual data is additionally or alternatively based on zero, one or more events which occur independent of any plays of any games at the EGM. For example, the collected data includes what non-gaming content, such as advertisements, was displayed to the player and when such content was displayed.

In certain embodiments, the collected player eye gaze contextual data is additionally or alternatively based on zero, one or more actions taken, such as via zero, one or more inputs, which occur after one or more events which occur independent of any plays of any games at the EGM. For example, the collected data includes which inputs are made by a player responsive to which non-gaming images are displayed to the player via a service window as well as the timing of such inputs.

In certain embodiments, the data collected in association with the event and/or action occurring includes information regarding when the event and/or action occurred as well as the environment (e.g., a date and time of the event and/or action, game name, player identifying information, game type, location of EGM, manufacturer of EGM, name of gaming establishment, location of gaming establishment, type of gaming establishment) in which the event and/or action occurred.

As described below, this data is subsequently used with the player eye gaze data to build a more complete picture of the player's experience at the EGM. For example, if data associated with an input made by a player during a play of a game is collected, the system also collects data including, but not limited to: where the player was looking at before, during and after the input was made, the time the input was made, the name of the game the input was made in, the category of game (i.e., selection game, skill-based game) the input was made in, the manufacturer of the game in which the input was made in, and the gaming establishment in which the game was played that the input was made in. Such collection of this additional data enables one or more entities, such as the gaming establishment operator and/or the EGM manufacturer, to have a better understanding of what the player looked at or did not look at responsive to the events and/or actions which occur (i.e., add context to the events and/or actions) to enable the entity to modify one or more aspects of one or more EGMs and thus enhance the operation of such EGMs.

It should be appreciated that any suitable data associated with any suitable quantifiable event which occurs in association with a player's gaming experience at an EGM and/or any suitable quantifiable action the player takes in association with the player's gaming experience at the EGM may be collected by the EGM as player eye gaze contextual data. That is, data associated with any traceable input made at the EGM and/or any traceable output from the EGM which: (i) occurs in association with one or more plays of one or more primary games at the EGM, (ii) occurs in association with one or more plays of one or more secondary games at the EGM, or (iii) occurs independent of any primary games or secondary games played at the EGM may be collected as part of (or in association with) the determined and collected eye gaze data.

In various embodiments, in addition to collecting player eye gaze data (including or otherwise associated with player eye gaze contextual data associated with any suitable quantifiable event which occurs in association with a player's gaming experience at a EGM and/or any suitable quantifiable action the player takes in association with the player's gaming experience at the EGM), as indicated by diamond 112 of FIG. 1, the EGM periodically determines if a collected data upload event has occurred.

In certain embodiments, a collected data upload event occurs responsive to an identified entity requesting the collected data. In certain embodiments, a collected data upload event periodically occurs at designated intervals, such as based on time and/or the amount of collected data reaching or exceeding a threshold amount of data. In certain embodiments, a collected data upload event occurs when the EGM detects, such as using one or more cameras and/or weight sensors, that a player has left the EGM. In certain embodiments, a collected data upload event occurs when a player logs out of a player tracking account at the EGM. In certain embodiments, a collected data upload event occurs when the player removes an amount of funds on a credit balance of the EGM. In certain embodiments, a collected data upload event occurs when a credit balance of the EGM is below a designated amount, such as $0.01 for a designated period of time without any additional funds being added (i.e., evidencing a termination of a gaming session). In certain embodiments, a collected data upload event occurs when a termination of a pairing or linkage occurs between a mobile device and the EGM (or a component of a gaming establishment management system, such as a SMIB, located inside the EGM).

In these embodiments, if a collected data upload event did not occur, the EGM continues monitoring any player eye gaze data as described above and indicated in block 104.

On the other hand, upon an occurrence of a collected data upload event, the EGM (or a component of a gaming establishment management system located inside the EGM) communicates the collected data to one or more servers associated with one or more identified entities utilizing one or more non-dedicated communication paths as indicated in block 114. That is, in certain embodiments, rather than utilizing a communication interface dedicated to communicating collected eye gaze data, the EGM utilizes one or more existing or legacy communication interfaces to transmit the collected data to one or more recipient servers, such as a gaming establishment management system server, and/or an EGM manufacturer server. In certain embodiments, the communication of the collected eye gaze data occurs via any suitable wired communication protocol and/or any suitable wireless communication protocol, including, but not limited to: Bluetooth™, Bluetooth™ Low Energy ("BLE"), one or more cellular communication standards (e.g., 3G, 4G, LTE), one or more Wi-Fi compatible standards, and one or more short range communication protocols (e.g., a near field communication ("NFC") protocol).

In one such embodiment, the EGM utilizes an existing wide area progressive award communication interface to communicate the collected data. In this embodiment, the EGM includes a wide area progressive award communication interface to communicate wide area progressive award data (e.g., wager amounts placed, the occurrence of a wide area progressive award winning outcome) to a wide area progressive award server associated with an identified entity, such as an EGM manufacturer, which maintains a wide area progressive award available to be won. In this embodiment, upon an occurrence of a collected data upload event, the EGM (or a component of a gaming establishment management system located inside the EGM) communicates, over the wide area progressive award communication interface, the collected data to the identified entity.

In another such embodiment, the EGM utilizes an existing player tracking system communication interface to communicate the collected data. In this embodiment, the EGM includes a player tracking system communication interface to communicate player tracking data (e.g., an occurrence of a card-in event, an amount of any wager amounts placed) to a player tracking server associated with an identified entity, such as an operator of the gaming establishment's loyalty program. In this embodiment, upon an occurrence of a collected data upload event, the EGM (or a component of a gaming establishment management system located inside the EGM) communicates, over the player tracking system communication interface, the collected eye gaze data to the identified entity.

It should be appreciated that any suitable communication interface of the EGM, such as but not limited to, an accounting communication interface which communicates accounting data to one or more accounting servers, a reservation communication interface which communicates reservation data to one or more gaming establishment reservation servers, a mobile device communication interface which communicates data to one or more mobile devices, an authentication communication interface which communicates authentication data to one or more authentication servers, a remote gaming interface which communicates data to one or more remote game servers, using any suitable communication protocols, such as but not limited to a Slot Accounting System (SAS) protocol, and/or a Game to System (G2S) protocol, may be utilized to communicate the collected data to one or more servers.

Accordingly, by collecting data associated with what a player looked at as part of their gaming experience, the system disclosed herein expands on the amount of data which may be subsequently analyzed to provide enhanced gaming experiences to players. That is, unlike existing gaming establishment player tracking systems which collect, due to certain bandwidth issues, a relatively small amount of gaming activity data, the use of one or more legacy communication interfaces to transmit data to one or more servers for further analysis increases the capacity of data collected by the system. Such an increased capacity of collected data fosters the development of EGMs more in tune with the needs and wants of gaming consumers (i.e., the servers analyze the collected eye gaze data associated with one or more historical gaming sessions to predict a player's future behavior based on the probability of different triggering factors occurring and how a player historically reacted to such triggering factors).

In another embodiment, the EGM utilizes one or more communication interfaces dedicated to communicating the collected eye gaze data. In this embodiment, rather than utilizing any existing communication interfaces to transmit such collected data, the EGM makes use of a dedicated communication interface to transmit the collected eye gaze data to one or more servers.

In certain embodiments, upon an occurrence of a collected data upload event, the EGM communicates all of the collected data to one or more servers. In certain embodiments, upon an occurrence of a collected data upload event, the EGM filters the collected data, such as based on one or more server defined filters and then communicates the filtered data to one or more servers. In certain embodiments, upon an occurrence of a collected data upload event, the EGM compresses the collected data and communicates the compressed collected data to one or more servers. In certain embodiments, upon an occurrence of a collected data upload event, the EGM culls certain of the collected data and communicates the remaining collected data to one or more servers.

In various embodiments, upon receiving the eye gaze data (including or otherwise associated with the player eye gaze contextual data), one or more servers analyze the received collected data to gain better insight into a player's play patterns, interests and activities. In certain embodiments, the collected eye gaze data replaces and/or supplements player tracking information with accurate and reliable collected data regarding what displayed content the player looked and/or what displayed content the player ignored or otherwise did not look at. By providing access to such data, the system disclosed herein is operable to enable interested parties, such as gaming establishment operators and EGM manufacturers, the ability to offer to a player a gaming establishment experience that is both unique to the player and specifically derived for the player based on the player's previous actions (e.g., eye gazes during one or more gaming sessions).

In certain embodiments, the system utilizes the received collected data regarding what displayed gameplay content the player looked and/or what displayed gameplay content the player ignored or otherwise did not look at from one or more EGMs to determine how different displayed gameplay content was looked at or not for different gaming sessions.

For example, the system utilizes the received collected data to determine that if a first gameplay feature was activated, players, on average, looked at content indicative of that first gameplay feature a first percentage of the time that first gameplay feature was active, but if a second, different gameplay feature was activated, players, on average, looked at content indicative of that second gameplay feature a second, lower percentage of the time that second gameplay feature was active. In this example, with such collected data, a gaming establishment manufacturer may determine that the content indicative of the second gameplay feature is too confusing (or otherwise is not properly conveying to players that the second gameplay feature is active) and needs to be altered. In these embodiments, the gameplay features which can be associated with one or more icons, symbols or messages associated with the activation of such features includes, but are not limited to, a book-end wild symbols feature; a stacked wild symbols feature; an expanding wild symbols feature; a nudging wild symbols feature; a retrigger symbol feature; an anti-terminator symbol feature; a locking reel feature, a locking symbol position feature; a modifier, such as a multiplier, feature; a feature modifying an amount of credits of a credit balance; a feature modifying an amount of promotional credits; a feature modifying a placed wager amount; a feature modifying a placed side wager amount; a feature modifying a rate of earning player tracking points; a feature modifying a number of wagered on paylines; a feature modifying a wager placed on one or more paylines (or on one or more designated paylines); a feature modifying a number of ways to win wagered on; a feature modifying a wager placed on one or more ways to win (or on one or more designated ways to win); a feature modifying a paytable utilized for a play of a game; a feature modifying an average expected payback percentage of a play of a game; a feature modifying an average expected payout of a play of a game; a feature modifying one or more awards available; a feature modifying a range of awards available; a feature modifying a type of awards available; a feature modifying one or more progressive awards; a feature modifying which progressive awards are available to be won; a feature modifying one or more modifiers, such as multipliers, available; a feature modifying an activation of a reel (or a designated reel); a feature modifying an activation of a plurality of reels; a feature modifying a generated outcome (or a designated generated outcome); a feature modifying a generated outcome (or a designated generated outcome) associated with an award over a designated value; a feature modifying a generated outcome (or a designated generated outcome) on a designated payline; a feature modifying a generated outcome (or a designated generated outcome) in a scatter configuration; a feature modifying a winning way to win (or a designated winning way to win); a feature modifying a designated symbol or symbol combination; a feature modifying a generation of a designated symbol or symbol combination on a designated payline; a feature modifying a generation of a designated symbol or symbol combination in a scatter configuration; a feature modifying a triggering event of a play of a secondary or bonus game; a feature modifying an activation of a secondary or bonus display (such as an award generator); a feature modifying a quantity of activations of a secondary or bonus display (e.g., a feature modifying a quantity of spins of an award generator); a feature modifying a quantity of sections of a secondary or bonus display (e.g., a feature modifying a quantity of sections of an award generator); a feature modifying one or more awards of a secondary or bonus display; a feature modifying an activation of a community award generator; a feature modifying a quantity of activations of a community award generator; a feature modifying a quantity of sections of a community award generator; a feature modifying one or more awards of a community award generator; a feature modifying a generated outcome (or a designated generated outcome) in a secondary game; a feature modifying a quantity of picks in a selection game; a feature modifying a quantity of offers in an offer and acceptance game; a feature modifying a quantity of moves in a trail game; a feature modifying an amount of free spins provided; a feature modifying a game terminating or ending condition; and/or a feature modifying any game play feature associated with any play of any game disclosed herein.

In certain embodiments, the system utilizes the received collected data regarding what displayed content the player looked and/or what displayed content the player ignored or otherwise did not look at from one or more EGMs to determine how different displayed content was looked at or not for different gaming sessions. That is, by coupling the collected eye gaze data with the collected player eye gaze contextual data, the system is able to determine how players actions (in terms of what players looked at) differ for different gaming session experiences. For example, the system utilizes the received collected data to determine that: (i) if a particular player had a first positive gaming session (i.e., a gaming session in which the player won over a threshold amount of money), that player looked at an advertisement for spa services offered by the gaming establishment for a first amount of time, (ii) if the same particular player had a second positive gaming session (i.e., a gaming session in which the player won money of an amount less than the threshold amount of money), that player looked at the same advertisement for spa services offered by the gaming establishment for a second, lower amount of time, and (iii) if the same player had a first negative gaming session (i.e., a gaming sessions in which that player lost over a threshold amount of money), that player looked at the same advertisement for spa services offered by the gaming establishment for a third, even lower amount of time. In this example, in view of such analysis, the gaming establishment operator is able to inform potential advertisers accurate and reliable information regarding how long a particular player, on average, looked at certain advertisements in association with different gaming session parameters, such that the potential advertisers (including the gaming establishment operator whom is advertising other attractions at the gaming establishment) can better focus their marketing campaigns.

In various embodiments, in addition to determining how long players looked at various displayed content, the system determines any follow-up actions taken by players responsive to looking at such displayed content.

In certain embodiments, the system determines how long, on average, the EGM displayed a first viewed image before an action was taken in association with that first viewed image compared to how long, on average, the EGM displayed a second, different viewed image before an action was taken in association with that second, viewed image. For example, the system determines that certain EGMs displayed a first icon to start a bonus game and that first icon was looked at by players for a first average duration before being selected, while certain other EGMs displayed a second, different icon to start a bonus game and that second icon was looked at by players for a second, greater average duration before being selected. In this example, with such collected data, a gaming establishment manufacturer may determine that the second icon to start the bonus game is too confusing (or otherwise is not properly conveying to players that the icon needs to be selected to start a bonus game) and needs to be altered.

In certain embodiments, the system determines how long, on average, the EGM displayed a viewed image before any action was taken in association with that viewed image. For example, the system determines that if a displayed advertisement is looked at by players but not selected by the player (for further information) within a threshold amount of time, such as within ten seconds, the odds that the displayed advertisement being subsequently selected drop drastically. In this example, with such collected data, a gaming establishment operator may alter operation of one or more EGMs by modifying the duration which such EGMs display one or more advertisements.

It should be appreciated that as more data is collected for more players and what displayed content these players looked at (or ignored) and what actions were taken (or not taken) by players responsive to what displayed contents these players looked at (or ignored) in association with different circumstances which occur at one or more EGMs, the system disclosed herein is able to provide more historically accurate information to interested parties, such as gaming establishment operators, EGM manufacturers and/or advertisers. After mining or otherwise analyzing the collected data, such interested parties can have a more defined picture of how different displayed content is viewed (or not) by different players. Continuing with the above example, as more data is collected for more players, the system is able to inform potential advertisers accurate and reliable information regarding how long players, on average, looked at certain advertisements in association with different gaming session parameters.

In various embodiments, in addition to analyzing the received collected data to determine what displayed content a player looked at for how long, one or more servers communicate one or more modifications to the EGM to cause the EGM to alter how it operates (or otherwise take one or more actions) responsive to the analysis of the collected data. In certain embodiments, the modification(s) communicated to the EGM pertain to altering how one or more icons, symbols and/or messages are displayed to the player after a threshold amount of time the player is detected to be looking at such icons, symbols and/or messages (e.g., the server notifies the EGM that if a symbol is looked at for more than a threshold amount of time (which is determined, at least in part, based on the analyzed data), the EGM should enlarge the symbol). In certain embodiments, the modification(s) communicated to the EGM pertain to predicting what displayed content a player may look at (based on the collected data) and providing the player an incentive, such as a loyalty award based on these determined predictions. In other embodiments, the system disclosed herein predicts what displayed content a player may look at and determines to display to a player a targeted advertisement based on these determined predictions. In these embodiments, the system utilizes the collected data to determine one or more advertisements specific to the player based on such information.

In certain embodiments, the incentives and advertisements correspond with actions which the system predicts the player will take. In these embodiments, the system does not attempt to alter the player's predicted behavior (i.e., what the player is predicted to look at), rather the system attempts to enhance this predicted behavior with additional benefits not previously provided (i.e., encourage the player to commence an anticipated action). In certain other embodiments, the incentives and advertisements provided to the player correspond with actions which the system determines the player would have historically taken, but has not taken for a designated period of time. In these embodiments, based on the determined shift in the player's behavior (i.e., what the player used to look at but is no longer looking at), the system attempts to alter the player's recently predicted behavior to a historically predicted behavior by providing additionally benefits to the player (i.e., encourage the player to revisit certain actions or activities which the player historically used to engage in but has not engaged in relatively recently for one or more reasons). In certain other embodiments, the incentives and advertisements provided to the player correspond with actions different from which the system predicts the player will take. In these embodiments, the system attempts to alter the player's predicted behavior (i.e., what the player is predicted to look at) by taking an action different than the action the player has historically taken in the same circumstance (i.e., encourage the player to commence an unanticipated action).

In certain embodiments, the EGM automatically collected the eye gaze data of the player at the EGM for subsequent analysis. In certain embodiments, the EGM enables a player to opt out from having their eye gaze data collected by the EGM for subsequent analysis. In certain embodiments, the EGM requires the player to opt-in or otherwise expressly give permission to have their eye gaze data collected by the EGM for subsequent analysis.

In certain embodiments, the system enables an operator to select whether or not to track and collect eye gaze data for one or more EGMs. In one such embodiment, the system enables the operator to select different levels of collection of eye gaze data for one or more EGMs. For example, an operator may select to track and collect all of the eye gaze data for a relatively newly placed EGM (to analyze how players are reacting to the EGM in terms of what the players are looking at during a gaming session on that EGM), while the operator may select to track and collect the eye gaze data associated with only bonus games of another EGM (to analyze how players are reacting to the bonus games of the EGM in terms of what the players are looking at during the play of such bonus games).

In certain embodiments, the EGM uses the player's head position as a view guide for the at least one data capture camera device. In these embodiments, since a player sitting directly in front of a display device of an EGM may see a different view than a player moving aside, the EGM accounts for the player's head position in determining the player eye gaze data.

In certain embodiments, upon an occurrence of an eye gaze data tracking initiation event (or periodically after such an occurrence), the EGM calibrates at least one data capture camera device and a display device of the EGM. In these embodiments, calibration of the at least one data capture camera device and the display device may be desirable because the eyes of each player using the EGM may be physically different, such as the shape and location of the player's eyes, and the capability for each player to see. Calibration is also beneficial because each player may stand or sit at a different position relative to the EGM. In these embodiments, the EGM calibrates the at least one data capture camera device by detecting the movement of the player's eyes, such as by displaying one or more calibration symbols followed by prompting the player text, noise, and/or graphical animation effect to direct their eye gaze to one or more of the calibration symbols. In such embodiments, the at least one data capture camera device monitors the eye gaze of the player looking at the one or more calibration symbols and a distance of the player's eyes relative to the EGM to collect calibration data. Based on the collected calibration data, such as based on how the player's eyes rotate to look from one position on the display device to a second position on the display device, the EGM calibrates the at least one data capture camera device to the player.

Figure 2:
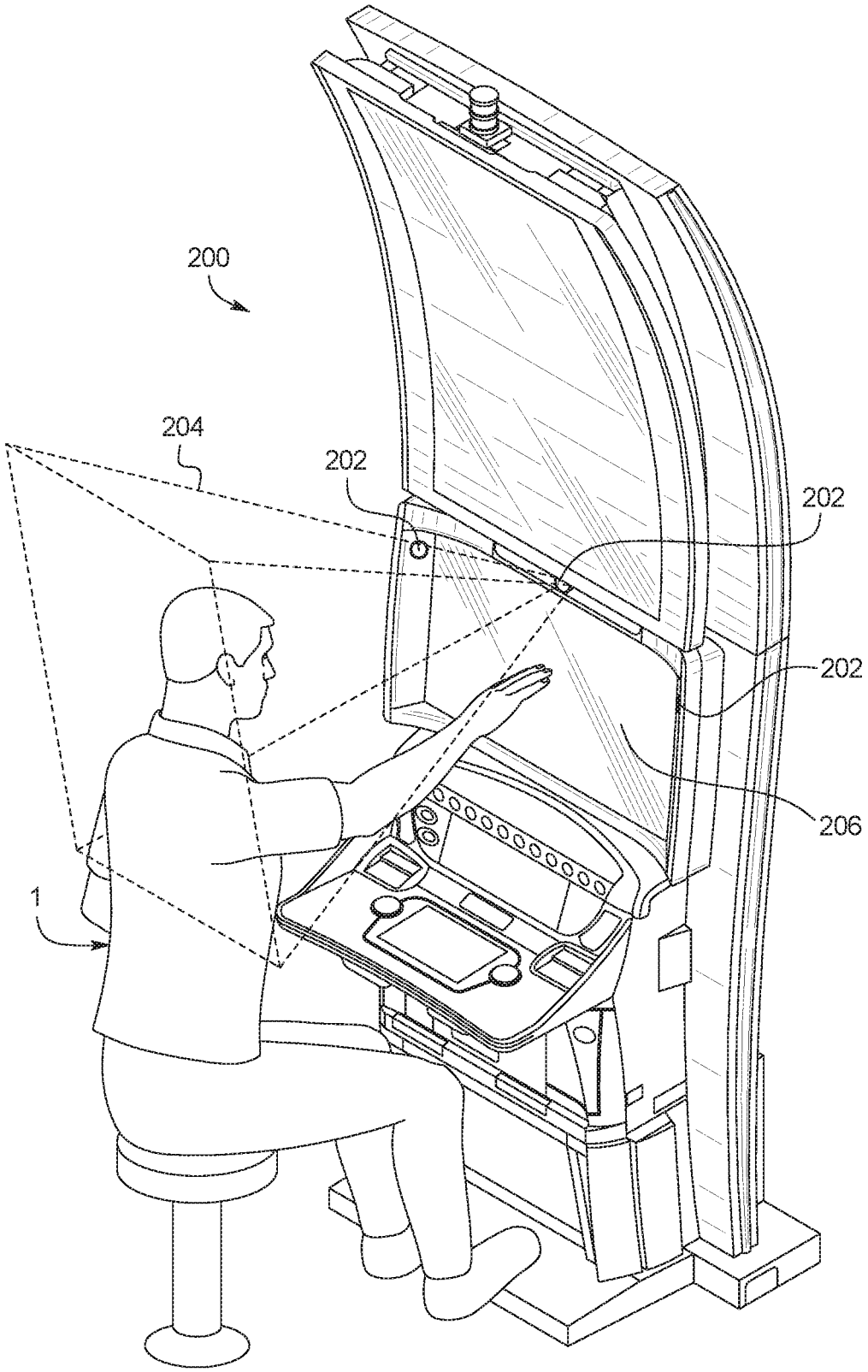
FIG. 2 is a schematic diagram illustrating the mapping of an eye gaze of a player to the viewing area of a display device of an electronic gaming machine as disclosed herein.

In certain embodiments, the EGM determines the location of the eye gaze relative to the viewing area of the display device based on the position of the player's eyes relative to the EGM and an angle of the player's eyes. In these embodiments, as seen in FIG. 2, one or more data capture camera device 202 monitors the position of the player's eyes/head to track the position of the player's eyes and/or the player's head as the player moves in an eye/head tracking zone such as the eye/head tracking zone 204 shown in front of the EGM 200. In this example, the EGM also monitors the angle of the player's eyes/head (which may be determined based on the calibration of the data capture camera device) to collect display mapping data. The angle of the player's eyes defines the focus of the eye gaze, which may be a line of sight relative to the display device 206. Based on the position of the player's eyes relative to the EGM and an angle of the player's eyes or the relative line of sight, the EGM determines the direction and length of a virtual array representing the eye gaze which is projecting from the player's eyes. The EGM of these embodiments determines where the virtual array intersects with the display device, wherein the intersection of virtual array and display device represents where the eye gaze of the player is focused on the display device. It should be appreciated that a player may maintain the focus of the player's eye gaze on the same portion of a display device of the EGM while changing the position of their eyes. It should be further appreciated that while illustrated as utilizing three data capture camera devices, any suitable number of data capture camera devices may be employed.

It should be appreciated that when interacting with the EGM, the eyes of a player may move suddenly without the player being conscious of the movement. The eyes of the player may demonstrate subconscious, quick, and short movements, even if the player is not actively controlling their eyes to move in this manner. These subconscious, quick, and short eye movements may affect the EGM's determination of the eye gaze of the player based on the player eye gaze data. Accurate processing of the player eye gaze data related to these subconscious, quick, and short eye movements may result in detecting the location of the eye gaze of the player representative of eye twitching or erratic eye movements not reflective of the player's intended eye gaze, which may be distracting to the player. As such, in certain embodiments, the player eye gaze data is filtered to not reflect these quick and short eye movements, for example, so the determination of the eye gaze of the player relative to the viewing area by the EGM reflects the intended eye gaze of the player. In one such embodiment, the EGM defines a filter movement threshold, wherein the EGM, prior to determining a location of the eye gaze of the player relative to the viewing area using the player eye gaze data collected by the at least one data capture camera device, determines that the player eye gaze meets the filter movement threshold. In certain embodiments, the portion of the player eye gaze data representative of the subconscious, quick, and short eye movements have less determinative effect on the determined location of the eye gaze of the player.

In certain embodiments, the EGM processes the player eye gaze data to correspond with a location on the viewing area of the display device, wherein the EGM determines where the player is looking at on the viewing area based on certain previously recorded player eye gaze data, such as by tracking the last ten eye gaze positions to average out where on the viewing area the player is looking. In these embodiments, the EGM limits the amount of previously recorded player eye gaze data that is used to determine where on the viewing area the player is looking. That is, the EGM filters or smooths out player eye gaze data outside of the predetermined filter movement threshold, which may represent sudden and subconscious eye movement. In these embodiments, the EGM maps the eye gaze of the player to the viewing area using at least a portion of the filtered player eye gaze data to determine the location of the viewing area at which the player is looking.

In certain embodiments, the EGM delays the processing of the player eye gaze data associated with subconscious, quick, and short eye movements, such that the detected location of the eye gaze of the player does not represent twitching or sudden unconscious eye movements which may trigger effects causing an unpleasant user experience. In certain embodiments, large eye motions, such as when the player loses focus or becomes distracted, are also associated with more delay in processing which the EGM filters out. In certain embodiments, the EGM partitions the player eye gaze data associated with large eye motions into data representative of shorter eye motions, wherein the EGM analyzes the player eye gaze data to determine which data is associated with subconscious eye movement or with conscious eye movement based on a filter movement threshold, a time threshold, and/or a movement threshold. In these embodiments, player eye gaze data associated with quick eye movements over a certain period of time may be determined by the EGM to be subconscious eye movement wherein the EGM delays the processing of (or ignores) this portion of data so the detected location of the eye gaze of the player may be stable. Similarly, player eye gaze data associated with large eye movements over a certain period of time may be determined by the EGM to be the player losing focus or being distracted, wherein the EGM delays the processing of (or ignores) this portion of data to filter or smooth out player eye gaze data, player eye gesture data, and/or player movement data that exceeds the filter movement threshold.

It should be appreciated that the locations where the EGM may be used, such as in a restaurant, a hotel lobby, an airport, and a gaming establishment, may have a variety of lighting conditions (i.e., it may be brighter in some locations and darker in other locations, or the light quality may fluctuate from brightness to darkness). To account for these different lighting conditions, in certain embodiments, the EGM includes an infrared light source that illuminates the player, but does not interfere with the eyes of the player. In certain embodiments, the at least one data capture camera device includes an infrared data capture camera device that collects player eye gaze data, player eye gesture data, and player movement data without being affected by the lighting conditions of the locations where the EGM is used. In certain embodiments, the EGM has a plurality of light sources providing a plurality of spectra of light, and the at least one data capture camera device includes a plurality of data capture camera devices configured to detect a plurality of spectra of light, such that the at least one data capture camera device collects player eye gaze data, player eye gesture data, and player movement data without being affected by the lighting conditions of the locations where the EGM is used.

It should be further appreciated that a player may be wearing glasses (with or without an infrared filter) which potentially cause refractions of the light that illuminates the player (and thus potentially affects the at least one data capture camera device while it monitors the eye gaze, eye gesture, and/or movement of the player). To account for this, in certain embodiments, the EGM ascertains whether or not the player is wearing glasses, such as by prompting the player regarding whether or not they are wearing glasses and/or determining, based on processing the player eye gaze data from the at least one data capture camera device, that the light illuminating the player is being refracted. In these embodiments, if the EGM recognizes that the player is wearing glasses, the EGM performs additional and/or more stringent filtering functions, such as setting a filter movement threshold to a higher threshold for players wearing glasses, to compromise for the player's use of glasses and to accommodate the refractions of the light that illuminates the player.

In certain embodiments, the EGM predicts the location of the eye gaze of the player relative to the viewing area of the display device at a future time using the player eye gaze data to facilitate dynamic updating of the content displayed in the viewing area. For example, if the EGM determines that a player is changing their gaze on a horizontal plane from the left to the right, the EGM predicts that the player is looking at a game component displayed on the right side of display device. In these embodiments, the ability for the EGM to predict the location of the eye gaze of the player at a future time assists in ruling out inaccurate readings. For example, while a player plays a game, the at least one data capture camera device may incorrectly detect a button on the clothing of a player to be the player's eyes, and may collect incorrect player eye gaze data based on the button. Based on the location of the eye gaze predicted by the EGM, the incorrect player eye gaze data may be ruled out by the EGM. In another example, by predicting the location of the eye gaze, the EGM adjusts the resolution of the display device where the player is not expected to be looking, thus conserving processing power of the EGM as not all visible game components require high resolution, but only the game components that the player is looking at require high resolution.

In certain embodiments, the EGM applies one or more predictive techniques to develop a plurality of predicted points of eye gaze, which, for example, may approximate and/or estimate where a player's gaze will travel next. These predictions are utilized for smoothing out and/or accounting for removal of transient readings, undesirable artefacts and/or inadvertent gaze positions. In certain embodiments, the predictions are used to improve the performance of the EGM in relation to gaze capture and/or processing thereof, by, for example, applying heuristic techniques to reduce the number of computations and/or capture frequency by relying on predictions to interpolate and/or extrapolate between gaze positions captured.

Alternative Embodiments

It should be appreciated that in different embodiments, one or more of:

i. whether to track and collect eye gaze data as part of a gaming session;
ii. whether to track and collect player eye gaze contextual data as part of a gaming session;
iii. when an eye gaze data tracking initiation event occurs;
iv. what eye gaze data to track and collect;
v. when to track and collect any eye gaze data;
vi. what player eye gaze contextual data to track and collect;
vii. when to track and collect any player eye gaze contextual data;
viii. when a collected data upload event occurs;
ix. what collected eye gaze data to upload to one or more servers;
x. what collected player eye gaze contextual data to upload to one or more servers;
xi. which server(s) to upload eye gaze data and player eye gaze contextual data to; and/or
xii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the data network is a WAN, the gaming system includes a central server, central controller, or remote host and an EGM (or personal gaming device) each located in a different gaming establishment in a same geographic area, such as a same city or a same state. Gaming systems in which the data network is a WAN are substantially identical to gaming systems in which the data network is a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server".

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3:
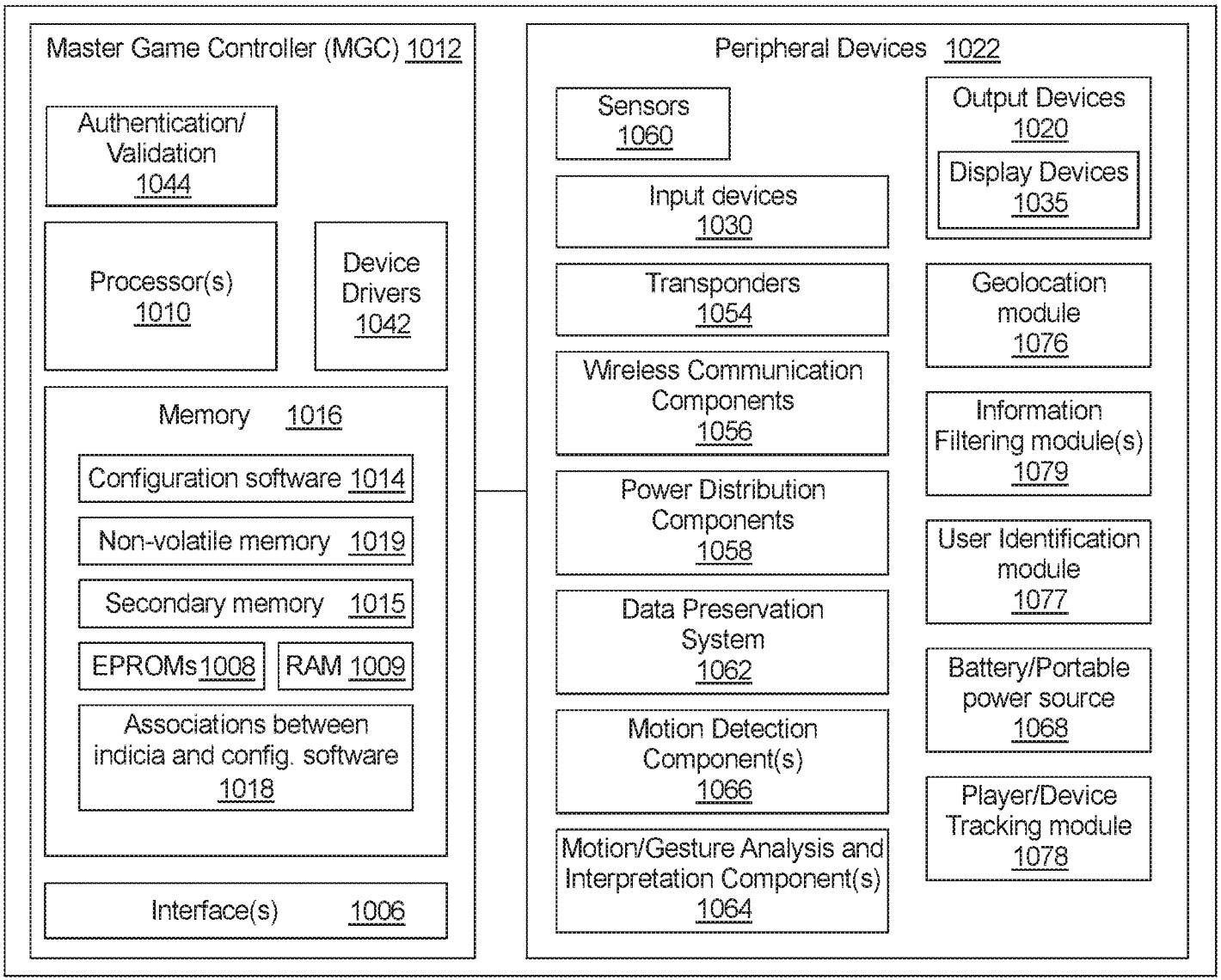
FIG. 3 is a schematic block diagram of one embodiment of an electronic configuration of an example gaming system disclosed herein.
Figure 4A:
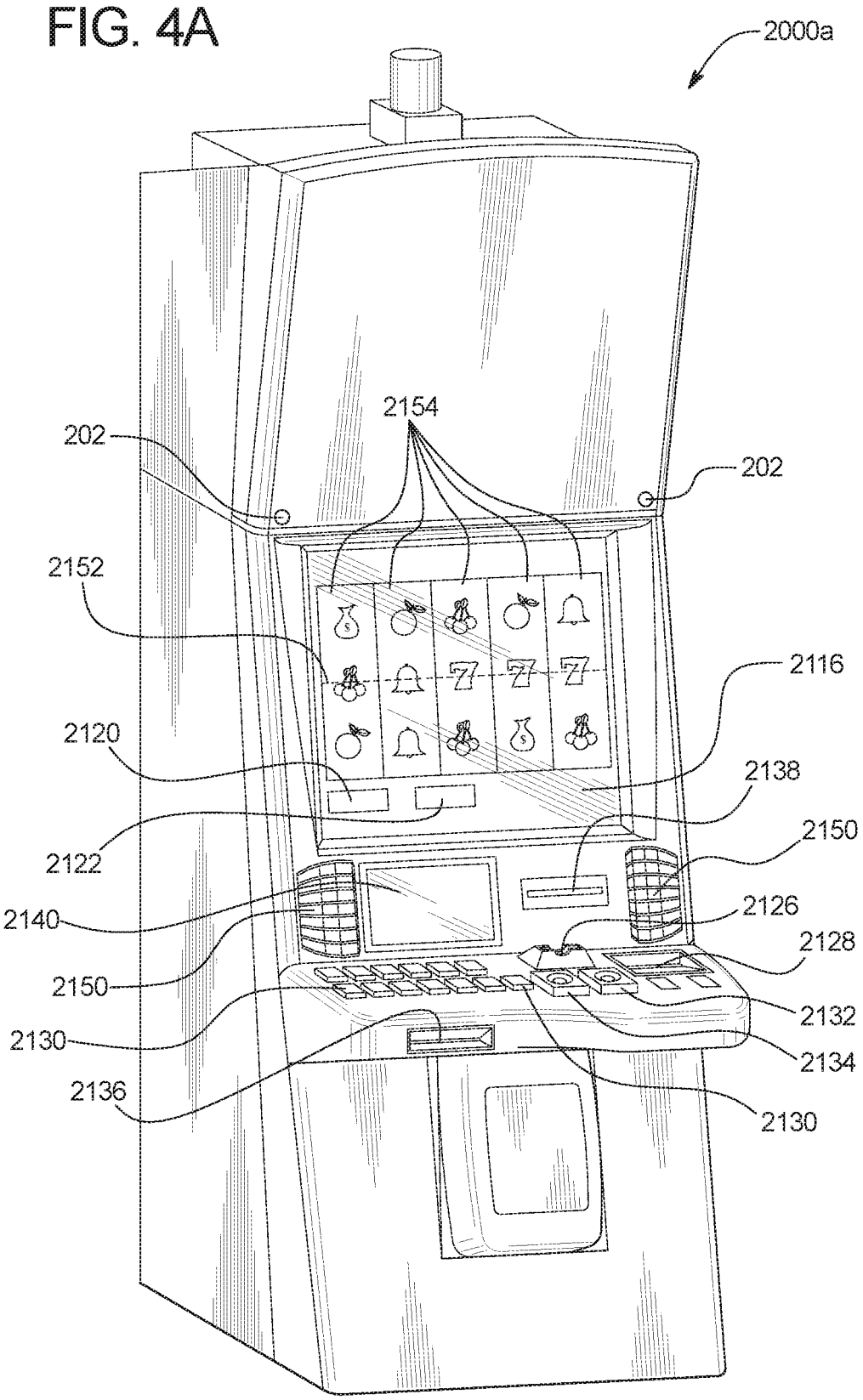
FIGS. 4A and 4B are perspective views of example alternative embodiments of the gaming system disclosed herein.
Figure 4B:
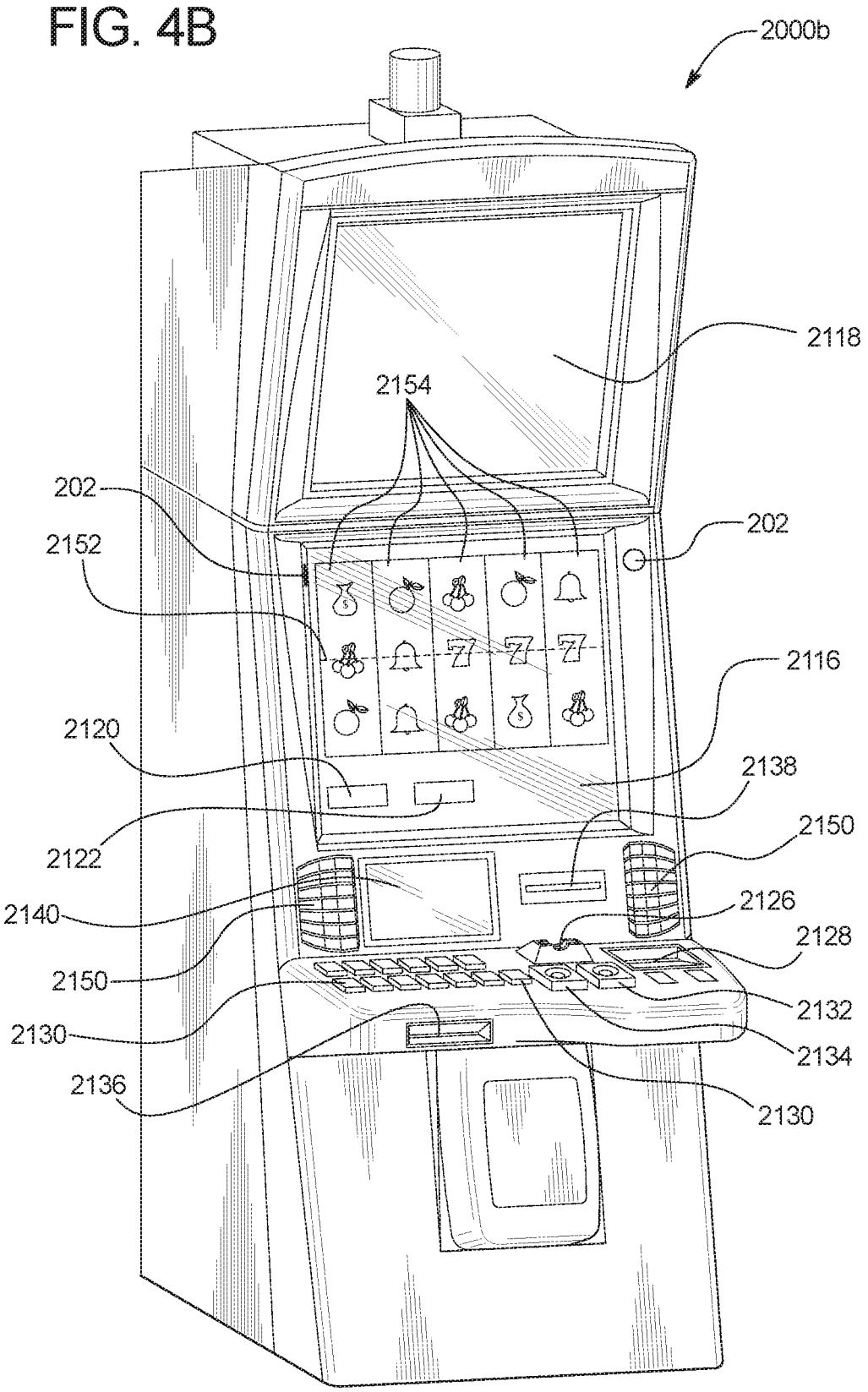
Figure 4C:
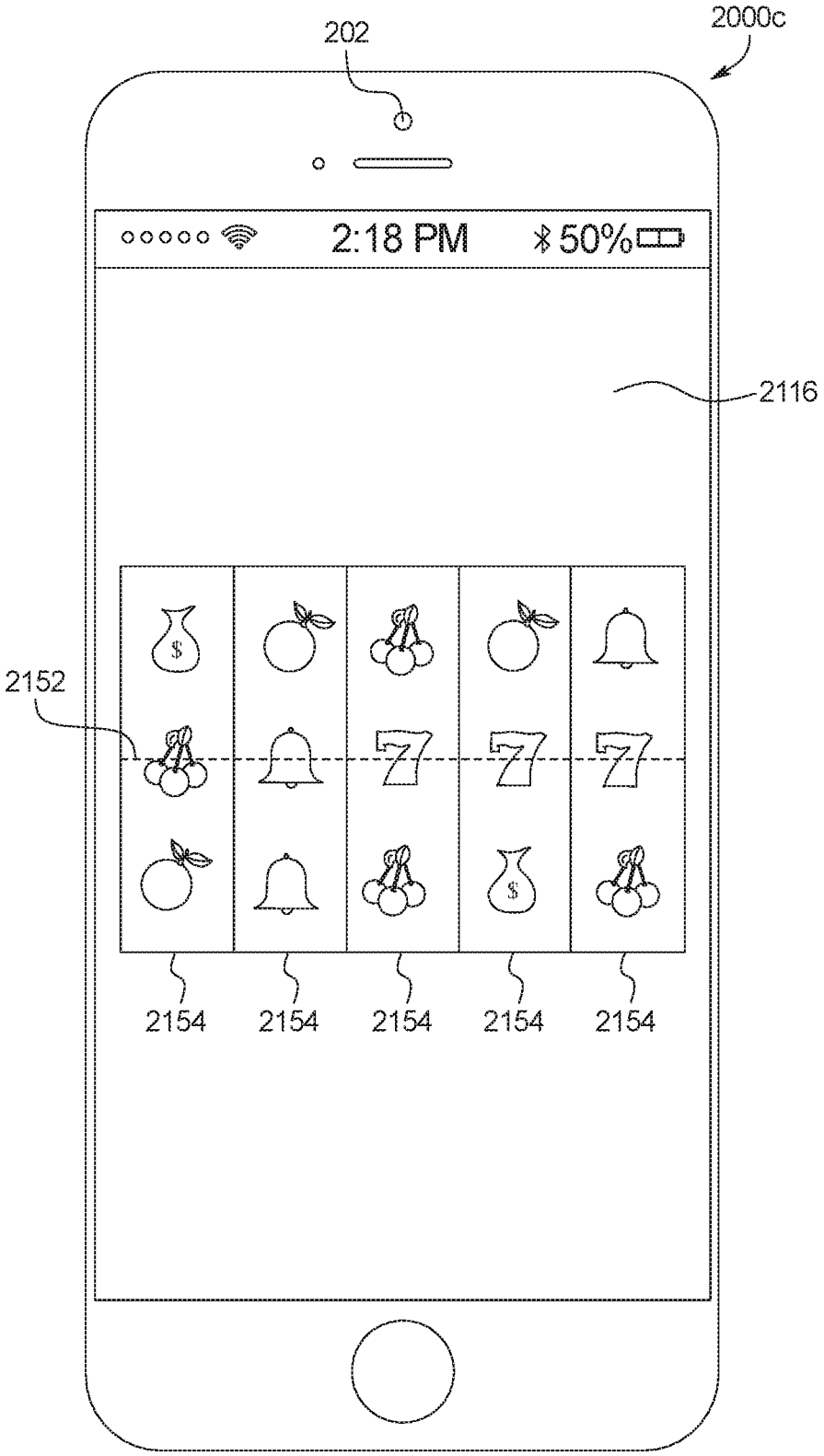
FIG. 4C is a front view of an example personal gaming device of the gaming system disclosed herein.

FIG. 3 is a block diagram of an example EGM 1000 and FIGS. 4A and 4B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*. Although the below refers to EGMs, in various embodiments personal gaming devices (such as personal gaming device 2000*c* of FIG. 4C) may include some or all of the below components.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM. In these embodiments, any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets".

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM **2000*a* illustrated in FIG. 4A includes a central display device 2116, a player tracking display 2140, a credit display 2120, and a bet display 2122. The example EGM 2000*b* illustrated in FIG. 4B includes a central display device 2116, an upper display device 2118, a player tracking display 2140, a credit display 2120, and a bet display 2122**.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 4A and 4B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; and U.S. Pat. No. 6,048,269, entitled "Coinless Slot Machine System and Method".

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine".

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 4A and 4B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 4A and 4B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine". When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 4A and 4B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 4A and 4B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 4A and 4B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 4A and 4B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player;

interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 4A and 4B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 4A and 4B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM before delivery to a gaming establishment or before being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b)

writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG such as a true RNG or a pseudo RNG; or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game".

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern".

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services".

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **2000*b* shown in FIG. 4B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; 8,241,104, entitled "Gaming Device and Method Having Designated Rules for Determining Ways To Win"; and 8,430,739, entitled "Gaming System and Method Having Wager Dependent Different Symbol Evaluations".

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards".

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win".

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services".

Web-Based Gaming

In various embodiments, the gaming system includes one or more servers configured to communicate with a personal gaming device—such as a smartphone, a tablet computer, a desktop computer, or a laptop computer—to enable web-based game play using the personal gaming device. In various embodiments, the player must first access a gaming website via an Internet browser of the personal gaming device or execute an application (commonly called an "app") installed on the personal gaming device before the player can use the personal gaming device to participate in web-based game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as a randomly determined game outcome and corresponding award), the one or more servers send the content to the personal gaming device, and the personal gaming device displays the content.

In certain such embodiments, the one or more servers must identify the player before enabling game play on the personal gaming device (or, in some embodiments, before enabling monetary wager-based game play on the personal gaming device). In these embodiments, the player must identify herself to the one or more servers, such as by inputting the player's unique username and password combination, providing an input to a biometric sensor (e.g., a fingerprint sensor, a retinal sensor, a voice sensor, or a facial-recognition sensor), or providing any other suitable information.

Once identified, the one or more servers enable the player to establish an account balance from which the player can draw credits usable to wager on plays of a game. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal or Venmo. The one or more servers also enable the player to cash out the player's account balance (or part of it) in any suitable manner, such as via an electronic funds transfer, by initiating creation of a paper check that is mailed to the player, or by initiating printing of a voucher at a kiosk in a gaming establishment.

In certain embodiments, the one or more servers include a payment server that handles establishing and cashing out players' account balances and a separate game server configured to determine the outcome and any associated award for a play of a game. In these embodiments, the game server is configured to communicate with the personal gaming device and the payment device, and the personal gaming device and the payment device are not configured to directly communicate with one another. In these embodiments, when the game server receives data representing a request to start a play of a game at a desired wager, the game server sends data representing the desired wager to the payment server. The payment server determines whether the player's account balance can cover the desired wager (i.e., includes a monetary balance at least equal to the desired wager).

If the payment server determines that the player's account balance cannot cover the desired wager, the payment server notifies the game server, which then instructs the personal gaming device to display a suitable notification to the player that the player's account balance is too low to place the desired wager. If the payment server determines that the player's account balance can cover the desired wager, the payment server deducts the desired wager from the account balance and notifies the game server. The game server then determines an outcome and any associated award for the play of the game. The game server notifies the payment server of any nonzero award, and the payment server increases the player's account balance by the nonzero award. The game server sends data representing the outcome and any award to the personal gaming device, which displays the outcome and any award.

In certain embodiments, the one or more servers enable web-based game play using a personal gaming device only if the personal gaming device satisfies one or more jurisdictional requirements. In one embodiment, the one or more servers enable web-based game play using the personal gaming device only if the personal gaming device is located within a designated geographic area (such as within certain state or county lines or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based game play if the personal gaming device is located outside of the designated geographic area.

In various embodiments, the gaming system includes an EGM configured to communicate with a personal gaming device—such as a smartphone, a tablet computer, a desktop computer, or a laptop computer—to enable tethered mobile game play using the personal gaming device. Generally, in these embodiments, the EGM establishes communication with the personal gaming device and enables the player to play games on the EGM remotely via the personal gaming device. In certain embodiments, the gaming system includes a geo-fence system that enables tethered game play within a particular geographic area but not outside of that geographic area. Examples of tethering an EGM to a personal gaming device and geo-fencing are described in U.S. Patent Appl. Pub. No. 2013/0267324, entitled "Remote Gaming Method Allowing Temporary Inactivation Without Terminating Playing Session Due to Game Inactivity".

Social Network Integration

In certain embodiments, the gaming system is configured to communicate with a social network server that hosts or partially hosts a social networking website via a data network (such as the Internet) to integrate a player's gaming experience with the player's social networking account. This enables the gaming system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming system to receive certain information from the social network server, such as the player's likes or dislikes or the player's list of connections. In certain embodiments, the gaming system enables the player to link the player's player account to the player's social networking account(s). This enables the gaming system to, once it identifies the player and initiates a gaming session (such as via the player logging in to a website (or an application) on the player's personal gaming device or via the player inserting the player's player tracking card into an EGM), link that gaming session to the player's social networking account(s). In other embodiments, the gaming system enables the player to link the player's social networking account(s) to individual gaming sessions when desired by providing the required login information.

For instance, in one embodiment, if a player wins a particular award (e.g., a progressive award or a jackpot award) or an award that exceeds a certain threshold (e.g., an award exceeding $1,000), the gaming system sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming system sends that information to the social network sever to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming system sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming system enables the player to recommend a game to the player's connections by posting a recommendation to the player's wall (or other suitable area) of the social networking website.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes".

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just before the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just before when the malfunction occurred. The restored state may include metering information and graphical information that was displayed on the EGM in the state before the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just before the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM before, during, and/or after the disputed game to demonstrate whether the player was correct or not in the player's assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play".

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification".

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment".

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System".

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electronic gaming machine comprising:

a display device;

an eye gaze data capture device;

a communication interface;

an input device;

a processor; and a memory device which stores a plurality of instructions, which when executed by the processor, cause the processor to:

cause the display device to display content, upon an occurrence of an eye gaze data tracking initiation event, cause the eye gaze data capture device to collect player eye gaze data relative to the displayed content, and upon an occurrence of a collected data upload event that occurs distinct from the collection of player eye gaze data related to the displayed content, communicate, via the communication interface, the collected player eye gaze data to a first server configured to analyze the collected player eye gaze data, wherein the communication, via the communication interface, of the collected player eye gaze data to the first server occurs in addition to a communication, via the communication interface, of non-player eye gaze data to a second server.

2. The electronic gaming machine of claim 1, wherein the displayed content comprises a play of a game and the player eye gaze data comprises player eye gaze contextual data associated with the play of the game.

3. The electronic gaming machine of claim 1, wherein the displayed content comprises an advertisement and the player eye gaze data comprises player eye gaze contextual data associated with the advertisement.

4. The electronic gaming machine of claim 3, wherein the second server is selected from the group consisting of: a progressive award server, a player tracking server, an accounting server, and a reservation server.

5. The electronic gaming machine of claim 1, wherein when executed by the processor, the instructions cause the processor to modify the collected player eye gaze data prior to communicating the collected player eye gaze data to the first server.

6. The electronic gaming machine of claim 5, wherein the modification of the collected player eye gaze data is selected from the group consisting of: a compression of the collected player eye gaze data and a culling of the collected player eye gaze data.

7. The electronic gaming machine of claim 1, wherein the first server is associated with an entity selected from the group consisting of: a gaming establishment, an advertiser, and an electronic gaming machine manufacturer.

8. A gaming establishment component comprising:

a communication interface configured to communicate with an electronic gaming machine which, upon an occurrence of an eye gaze data tracking initiation event, causes an eye gaze data capture device to collect player eye gaze data relative to content displayed by an electronic gaming machine display device;

a processor; and a memory device which stores a plurality of instructions, which when executed by the processor, cause the processor to:

upon an occurrence of a collected data upload event that occurs distinct from the collection of player eye gaze data related to the content displayed by the electronic gaming machine display device, receive, via the communication interface and from the electronic gaming machine, the collected player eye gaze data, wherein the communication of the collected player eye gaze data via the communication interface occurs in addition to a communication, via the communication interface, of non-player eye gaze data to another gaming establishment component, analyze the collected player eye gaze data, and communicate, via the communication interface and to the electronic gaming machine, at least one modification of the electronic gaming machine, the modification being based on the analyzed player eye gaze data.

9. The gaming establishment component of claim 8, wherein the displayed content comprises a play of a game and the player eye gaze data comprises player eye gaze contextual data associated with the play of the game.

10. The gaming establishment component of claim 8, wherein the displayed content comprises an advertisement and the player eye gaze data comprises player eye gaze contextual data associated with the advertisement.

11. The gaming establishment component of claim 8, wherein the processor is associated with an entity selected from the group consisting of: a gaming establishment, an advertiser, and an electronic gaming machine manufacturer.

12. A method of operating an electronic gaming machine, the method comprising:

displaying, by a display device, content, upon an occurrence of an eye gaze data tracking initiation event, causing an eye gaze data capture device to collect player eye gaze data relative to the displayed content, and upon an occurrence of a collected data upload event that occurs distinct from the collection of player eye gaze data related to the displayed content, communicating, via a communication interface, the collected player eye gaze data to a first server configured to analyze the collected player eye gaze data, wherein the communication, via the communication interface, of the collected player eye gaze data to the first server occurs in addition to a communication, via the communication interface, of non-player eye gaze data to a second server.

13. The method of claim 12, wherein the displayed content comprises a play of a game and the player eye gaze data comprises player eye gaze contextual data associated with the play of the game.

14. The method of claim 12, wherein the displayed content comprises an advertisement and the player eye gaze data comprises player eye gaze contextual data associated with the advertisement.

15. The method of claim 12, wherein the second server is selected from the group consisting of: a progressive award server, a player tracking server, an accounting server, and a reservation server.

16. The method of claim 12, further comprising modifying, by a processor, the collected player eye gaze data prior to communicating the collected player eye gaze data to the first server.

17. The method of claim 16, wherein the modification of the collected player eye gaze data is selected from the group consisting of: a compression of the collected player eye gaze data and a culling of the collected player eye gaze data.

18. The method of claim 12, wherein the first server is associated with an entity selected from the group consisting of: a gaming establishment, an advertiser, and an electronic gaming machine manufacturer.

* * * * *